US007657195B2

(12) United States Patent
Kim

(10) Patent No.: US 7,657,195 B2
(45) Date of Patent: Feb. 2, 2010

(54) OPTIONAL APPARATUS OF IMAGE FORMING DEVICE FOR SETTING ITS OWN DRIVING CONDITION USING RECEIVED SPECIFICATION INFORMATION OF MAIN BODY AND CONTROL METHOD THEREOF

(75) Inventor: Sun-jin Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 271 days.

(21) Appl. No.: 11/165,237

(22) Filed: Jun. 24, 2005

(65) Prior Publication Data

US 2005/0286923 A1 Dec. 29, 2005

(30) Foreign Application Priority Data

Jun. 25, 2004 (KR) ..... 10-2004-0048302

(51) Int. Cl.
*G03G 15/00* (2006.01)

(52) U.S. Cl. ..... 399/36; 399/391; 399/396

(58) Field of Classification Search ..... 399/110, 399/389, 391, 393, 407, 36, 38, 388, 396
See application file for complete search history.

(56) References Cited

U.S. PATENT DOCUMENTS

| | | | | |
|---|---|---|---|---|
| 5,086,309 | A * | 2/1992 | Iida et al. | 347/139 |
| 5,513,334 | A | 4/1996 | Alexander | 711/103 |
| 5,774,764 | A * | 6/1998 | Toyokura et al. | 399/77 |
| 5,963,755 | A * | 10/1999 | Ueda et al. | 399/23 |
| 6,122,464 | A * | 9/2000 | Kakigi | 399/82 |
| 6,169,567 | B1 * | 1/2001 | Hashimoto et al. | 347/262 |
| 6,516,167 | B2 * | 2/2003 | Takamura | 399/75 |
| 6,697,679 | B2 * | 2/2004 | Hatakeyama | 700/13 |
| 6,721,535 | B2 * | 4/2004 | Hatano | 399/396 |
| 6,795,665 | B2 * | 9/2004 | Miura | 399/90 |
| 6,963,698 | B2 * | 11/2005 | Kondo | 399/8 |

(Continued)

FOREIGN PATENT DOCUMENTS

| | | |
|---|---|---|
| JP | 05-069988 | 3/1993 |

(Continued)

OTHER PUBLICATIONS

Official Action issued by the Korean Intellectual Property Office concerning Korean Patent Application No. 10-2004-0048302 dated Mar. 16, 2006.

*Primary Examiner*—Robert Beatty
(74) *Attorney, Agent, or Firm*—Staas & Halsey LLP

(57) ABSTRACT

An optional apparatus of an image forming device is provided for setting its own driving condition using received specification information of a main body and method thereof. The optional apparatus is additionally combined into the main body of the image forming device to expand functions of the image forming device, and includes a driving unit driven to perform an addition function required to expand the functions of the image forming device, and a control unit for receiving specification information of the main body, setting a driving condition of the driving unit based on the received specification information, and then controlling the driving unit according to the set driving condition. The optional apparatus can be implemented as a general optional apparatus that can be combined into any kind of image forming device.

17 Claims, 6 Drawing Sheets

U.S. PATENT DOCUMENTS

2003/0048474 A1* 3/2003 Hong et al. ..... 358/1.15

FOREIGN PATENT DOCUMENTS

JP 2001-175584 6/2001
JP 2002-307718 10/2002
JP 2003-080796 3/2003
KR 1998-86839 12/1998

* cited by examiner

OPTIONAL APPARATUS OF IMAGE FORMING DEVICE FOR SETTING ITS OWN DRIVING CONDITION USING RECEIVED SPECIFICATION INFORMATION OF MAIN BODY AND CONTROL METHOD THEREOF

CROSS-REFERENCE TO RELATED APPLICATIONS

This application claims the benefit of Korean Patent Application No. 2004-48302, filed Jun. 25, 2004 in the Korean Intellectual Property Office, the disclosure of which is incorporated herein by reference.

BACKGROUND OF THE INVENTION

1. Field of the Invention

The present invention relates to an optional apparatus of an image forming device, and more particularly to an optional apparatus of an image forming device that is additionally combined into a main body of the image forming device to expand the function of the image forming device and a control method thereof.

2. Description of the Related Art

Image forming devices output image data produced by the devices themselves or received from an outside source on printing paper. The image forming devices may be copying machines, printers, scanners, facsimile machines and multifunction devices in which two or more devices are combined together.

An optional apparatus of an image forming device is additionally combined into the main body of the image forming device, for expanding the function of the image forming device as needed. The representative optional apparatus of the image forming device may be an optional feeding apparatus. The optional feeding apparatus is additionally combined into the main body of the image forming device to make it possible to additionally feed printing papers of sizes different from those of printing papers that can be fed through feeding trays combined into the main body of the image forming device.

FIG. 1A is a perspective view of a conventional multifunction image forming device. As illustrated in FIG. 1A, the multifunction image forming device includes a main body 10 and A4/B4 feeding trays 20-1 and 20-2 combined into the main body 10.

FIG. 1B is a sectional view of the multifunction image forming device of FIG. 1A. As illustrated in FIG. 1B, the main body 10 includes A4/B4 feeding units 17-1 and 17-2, that are fixedly provided at predetermined positions in the image forming device, for feeding A4/B4 printing papers loaded in the A4/B4 feeding trays 20-1 and 20-2 to a printing unit (not illustrated) for printing images.

Hereinafter, the operation of the multifunction image forming device will be explained.

FIG. 2 is a block diagram illustrating the internal construction of the conventional multifunction image forming device. Referring to FIG. 2, the main body 10 of the multifunction image forming device includes a scanning unit 11, a storage unit 13, a control unit 15, A4/B4 feeding units 17-1 and 17-2 and a printing unit 19. Additionally, A4/B4 feeding trays 20-1 and 20-2 are combined into the main body 10.

The scanning unit 11 produces image data by scanning manuscript papers. The storage unit 13 is a recording medium in which the image data produced from the scanning unit 11 and print data transmitted from a PC (not illustrated) are stored. The A4/B4 feeding units 17-1 and 17-2 feed the printing papers loaded in the A4/B4 feeding trays 20-1 and 20-2 to the printing unit 19. The printing unit 19 prints the image data and the print data stored in the storage unit 13 on the printing papers fed by the A4 feeding unit 17-1 or the B4 feeding unit 17-2. The control unit 15 controls the scanning operation, feeding operation and printing operation.

According to the conventional multifunction image forming device, as illustrated in FIG. 1B, the A4/B4 feeding units 17-1 and 17-2 are fixedly provided in specified positions in the main body 10, and spaces for mounting the A4/B4 feeding trays 20-1 and 20-2 therein are provided in the lower parts of the A4/B4 feeding units 17-1 and 17-2, respectively.

Accordingly, if the user uses only A4 printing papers as the printing papers, the B4 feeding unit 17-2 and the B4 feeding tray 20-2 that are not in use become useless.

Additionally, in order to make it possible to feed printing papers of a different size, for example, of a B5 size, to the multifunction image forming device, a 'B5 feeding apparatus' should be added to the lower part of the multifunction image forming device as an optional feeding apparatus. The 'B5 feeding apparatus' is provided with a 'B5 feeding unit', and has a space in which a 'B5 feeding tray' is mounted. However, the 'B5 feeding unit' provided in the 'B5 feeding apparatus' operates under the control of the control unit 15 in the same manner as the existing A4/B4 feeding units 17-1 and 17-2, and thus the 'B5 feeding apparatus' should be manufactured in consideration of the kind of the multifunction image forming device. As a result, the 'B5 feeding apparatus' cannot be used as the optional feeding apparatus of the multifunction image forming device of a different kind. Accordingly, the development and the manufacturing of the optional feeding apparatus should be separately performed according to the kind of the optional feeding apparatus, and this causes the development of the optional feeding apparatus to be troublesome.

SUMMARY OF THE INVENTION

Additional aspects and/or advantages of the invention will be set forth in part in the description which follows and, in part, will be apparent from the description, or may be learned by practice of the invention.

The present invention has been developed in order to solve the above drawbacks and other problems associated with the conventional arrangement. An aspect of the present invention is to provide an optional apparatus of an image forming device that can remove an unnecessary feeding unit and space for mounting feeding trays therein from the main body of the image forming device by separating the fixed feeding unit from the main body of the image forming device and implementing the feeding unit as a separate optional feeding apparatus along with the feeding trays.

Another aspect of the present invention is to provide a general optional apparatus of an image forming device that can be combined into any kind of image forming device.

Still another aspect of the present invention is to provide a technical means that can implement other optional apparatuses as general optional apparatuses in addition to the above-described optional feeding apparatus.

The foregoing and other objects and advantages are substantially realized by providing an optional apparatus of an image forming device that is additionally combined into a main body of the image forming device to expand functions of the image forming device, according to the present invention, which includes a driving unit driven to perform an additional function required to expand the functions of the image forming device, and a control unit for receiving specification information of the main body, setting a driving condition of the driving unit based on the received specification information, and then controlling the driving unit according to the set driving condition.

The optional apparatus may further include a memory for storing the driving condition set by the control unit, where the control unit, if a driving command is received from the main body, controls the driving unit according to the driving condition stored in the memory.

The control unit may transmit an abnormal operation reporting message to the main body if the driving unit operates abnormally.

The specification information may be driving characteristic information of the main body. Also, the control unit may receive the specification information from the main body through an $I^2C$ (Inter-Integrated Circuit) bus.

Additionally, the additional function performed by the driving unit may be any one of a printing paper feeding function, an automatic manuscript paper feeding function, and a printed paper classifying/sorting function.

In another aspect of the present invention, there is provided a method for controlling an optional apparatus of an image forming device that is additionally combined into a main body of the image forming device to expand the functions of the image forming device, according to the present invention, which includes receiving specification information of the main body, setting a driving condition of a driving unit driven to perform an addition function required to expand the functions of the image forming device based on the received specification information, and controlling the driving unit according to the set driving condition.

The method may further include storing the set driving condition, where controlling the driving unit according to the stored driving condition occurs if a driving command is received from the main body, The method may further include transmitting an abnormal operation reporting message to the main body if the driving unit operates abnormally.

The specification information may be driving characteristic information of the main body. Also, receiving the specification information from the main body may occur through an $I^2C$ (Inter-Integrated Circuit) bus.

Further, the additional function performed by the driving unit may be any one of a printing paper feeding function, an automatic manuscript paper feeding function, and a printed paper classifying/sorting function.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Figure 1A:
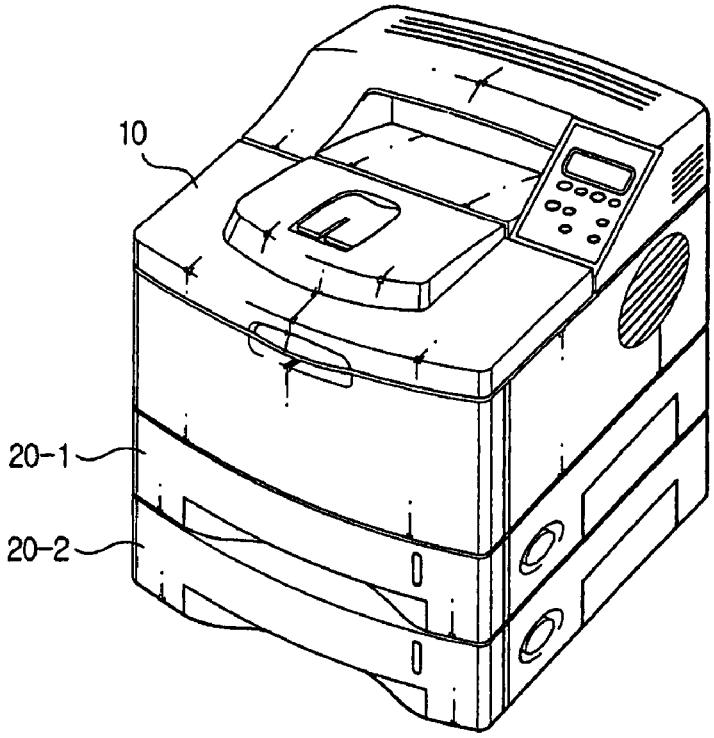
FIG. 1A (PRIOR ART)
FIG. 1A is a perspective view of a conventional multifunction image forming device.
Figure 1B:
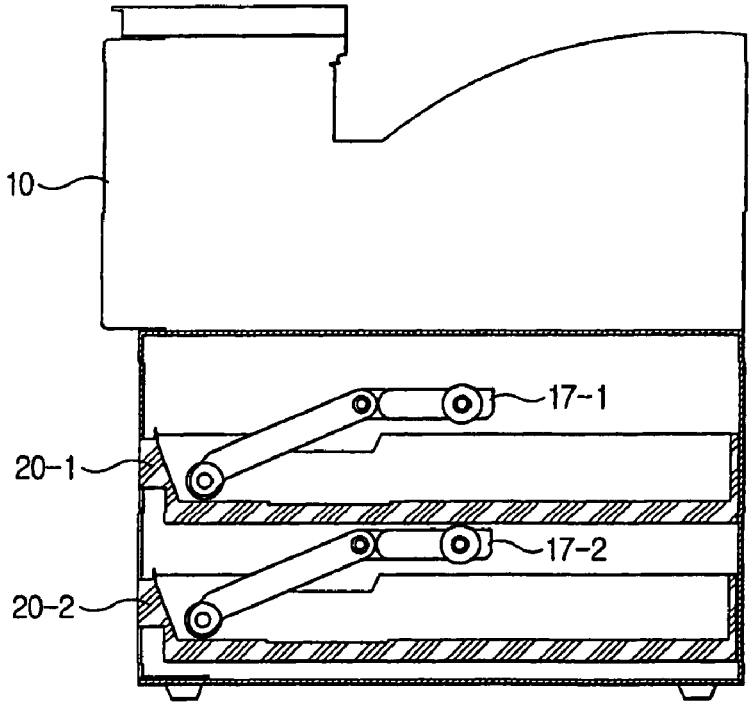
FIG. 1B (PRIOR ART)
FIG. 1B is a sectional view of the multifunction image forming device of FIG. 1A.
Figure 2:
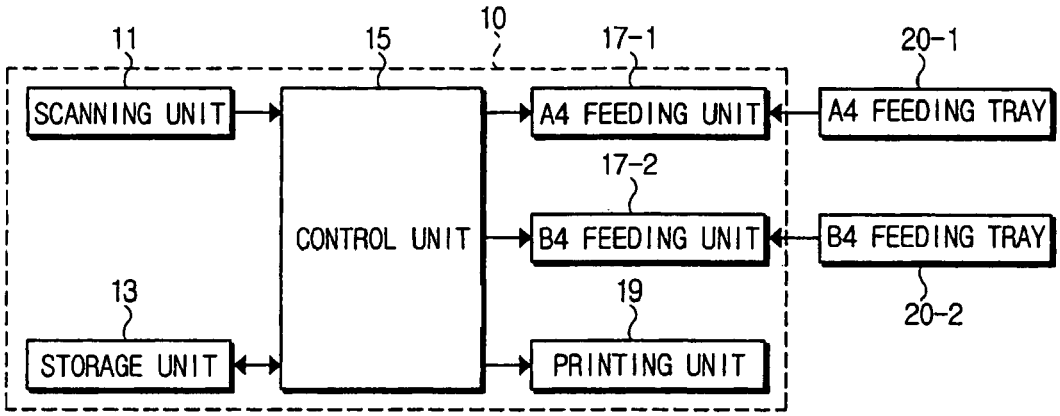
FIG. 2 (PRIOR ART)
FIG. 2 is a block diagram illustrating the internal construction of a conventional multifunction image forming device.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
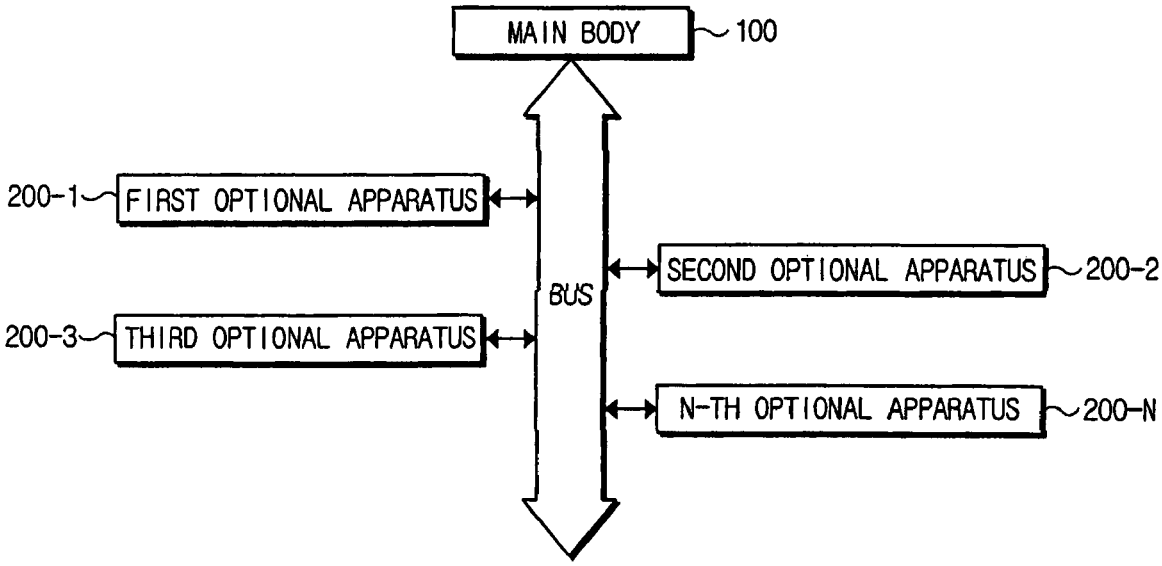
FIG. 3 is a block diagram illustrating optional apparatuses that are communicably connected to the main body according to an embodiment of the present invention.

FIG. 3 is a block diagram illustrating optional apparatuses that are communicably connected to the main body according to an embodiment of the present invention.

A plurality of optional apparatuses (i.e., first to N-th optional apparatuses) 200-1 to 200-N can be combined into a main body 100 of an image forming device structurally and electrically, and the optional apparatus combined into the main body is not limited in kind. Accordingly, the optional apparatuses 200-1 to 200-N combined into the main body 100 may be any of optional feeding apparatuses, automatic manuscript paper feeding apparatuses and finishers. The automatic manuscript paper feeding apparatus is an optional apparatus for automatically feeding the manuscript papers to the main body 100, and the finisher is an optional apparatus for classifying and sorting the printed papers after the completion of the printing in the main body 100.

The main body 100 and the optional apparatuses 200-1 to 200-N are combined together in structure and are communicably connected together through a bus simultaneously. Accordingly, the main body 100 and the optional apparatuses 200-1 to 200-N can mutually communicate with one another through the bus.

Hereinafter, the main body 100 and the optional apparatuses 200-1 to 200-N will be explained in more detail with reference to FIG. 4. For convenience of explanation, FIG. 4 illustrates one optional apparatus 200 combined into the main body 100.

Figure 4:
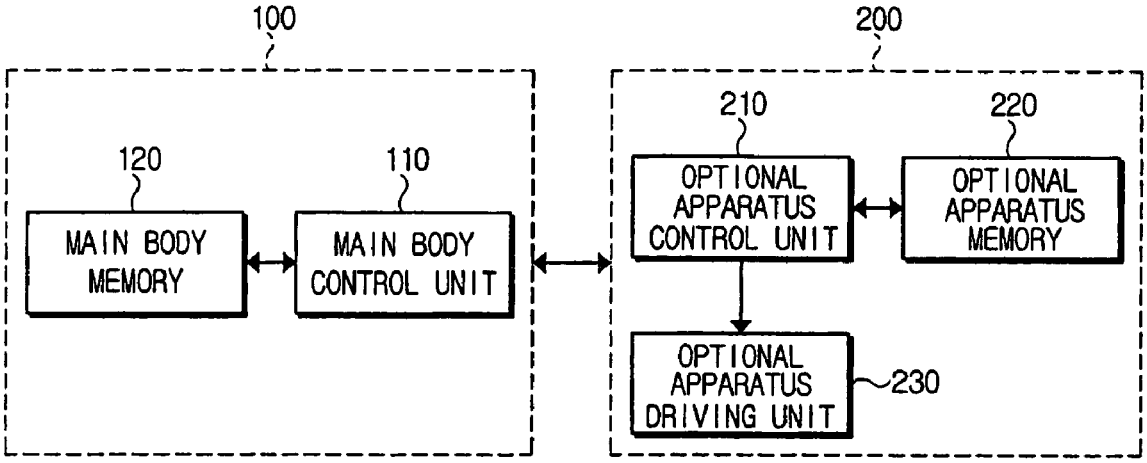
FIG. 4 is a block diagram illustrating the main body and the optional apparatus of FIG. 3.

Referring to FIG. 4, the main body 100 is provided with a main body control unit 110 and a main body memory 120. The optional apparatus 200 is provided with an optional apparatus control unit 210, an optional apparatus memory 220 and an optional apparatus driving unit 230.

The main body control unit 110 controls the whole operation of the main body 100, and performs data communications with the optional apparatus control unit 210 through the bus. Specifically, the main body control unit 110 searches for the optional apparatus 200 combined into the main body 100, and receives 'optional apparatus specification information' from the searched optional apparatus 200. Additionally, the main body control unit 110 transmits 'main body specification information' and a 'optional apparatus driving command' to the optional apparatus 200. Here, the specification information includes the kind of the device, driving characteristic, etc. Accordingly, the 'main body specification information' includes the kind and the driving characteristic of the main body 100, and the 'optional apparatus specification information' includes the kind and the driving characteristic of the optional apparatus 200.

The main body memory 120 is a recording medium in which the 'main body specification information' and the 'optional apparatus specification information' received from the optional apparatus control unit 210 are stored.

The optional apparatus control unit 210 controls the whole operation of the optional apparatus 200, and performs data communications with the main body control unit 110 through the bus. Specifically, the optional apparatus control unit 210 transmits the 'optional apparatus specification information' to the main body 100, and receives the 'main body specification information' from the main body 100. Additionally, the optional apparatus control unit 210 sets the 'driving condition' of the optional apparatus driving unit 230 using the received 'main body specification information'. If the 'driving command' is received from the main body control unit 110, the optional apparatus control unit 210 controls the optional apparatus driving unit 230 according to the set 'driving condition'.

The optional apparatus memory 220 is a recording medium in which the 'optional apparatus specification information', the 'main body specification information' received from the main body control unit 110, and the set 'driving condition' are stored.

The optional apparatus driving unit 230 performs the corresponding function of the optional apparatus 200. The optional apparatus driving unit 230 performs different functions in accordance with the kind of the optional apparatus 200. Specifically, if the optional apparatus 200 is an optional feeding apparatus, the optional apparatus driving unit 230 performs a printing paper feeding function while if the optional apparatus 200 is a finisher, the optional apparatus driving unit 230 performs a printed paper classifying/sorting function. The optional apparatus driving unit 230 is driven under the control of the optional apparatus control unit 210.

Figure 5:
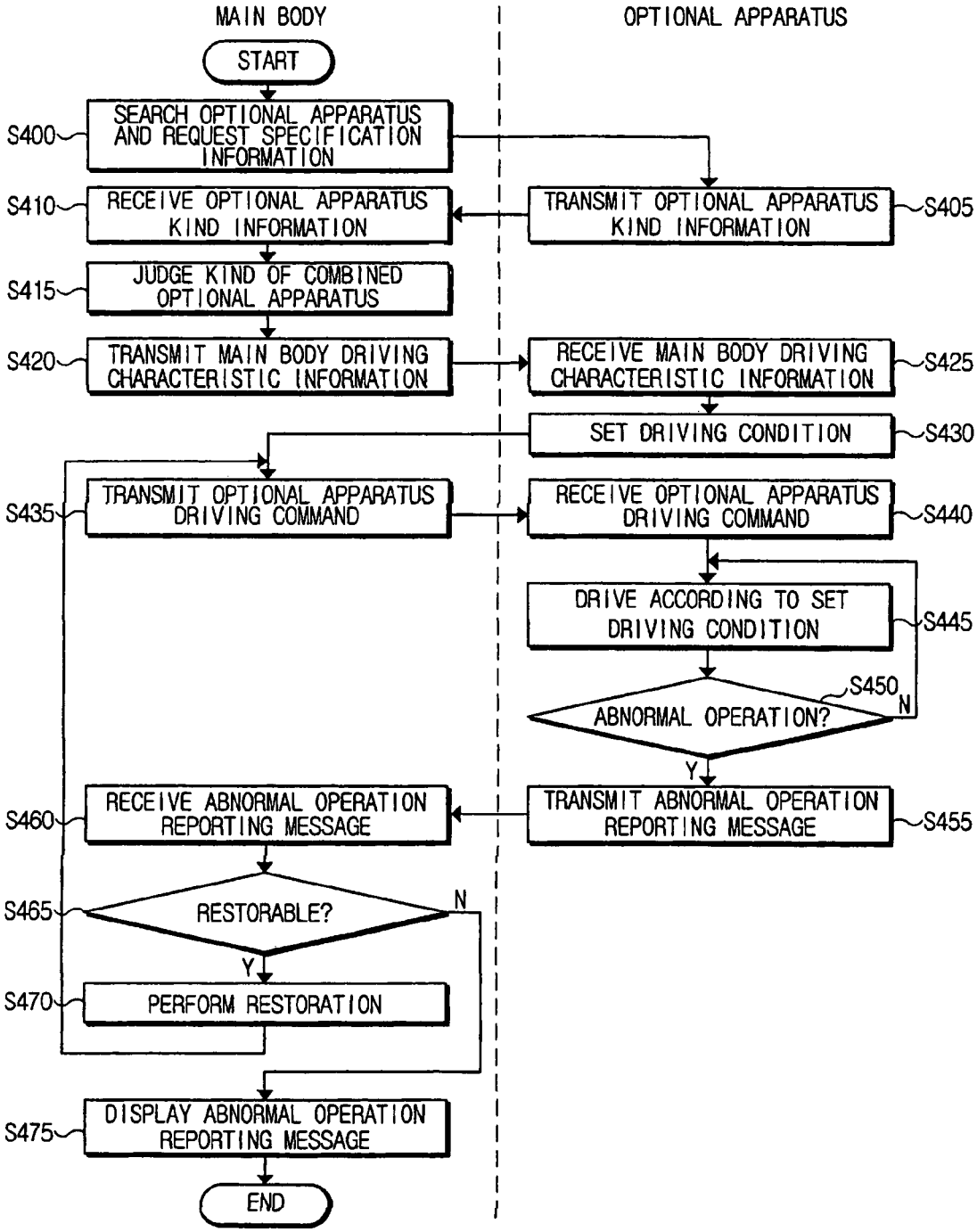
FIG. 5 is a flowchart illustrating a method for setting a driving condition of an optional apparatus using transmitted specification information of the main body according to an embodiment of the present invention.

Hereinafter, the process of setting the 'driving condition' of the optional apparatus 200 itself through mutual communication if the main body 100 and the optional apparatus 200 are combined together will be explained in detail with reference to FIG. 5. FIG. 5 is a flowchart illustrating a method for setting the driving condition of the optional apparatus using the transmitted specification of the main body according to an embodiment of the present invention. For the purpose of convenience, operations performed by the main body 100 are illustrated on the left side of FIG. 5, and operations performed by the optional apparatus 200 are illustrated on the right side of FIG. 5.

The main body control unit 110 searches for the optional apparatus 200 combined into the main body 100, and requests the specification information of the searched optional apparatus 200 (operation S400). The optional apparatus control unit 210 reads 'optional apparatus kind information' from the optional apparatus memory 220 as the 'optional apparatus specification information', and transmits the read 'optional apparatus kind information' to the main body control unit 110 (operation S405). The main body control unit 110, if the 'optional apparatus kind information' is received (operation S410), judges the kind of the optional apparatus 200 combined into the main body 100 through the received 'optional apparatus kind information' (operation S415).

At operations S400 to S415, the main body control unit 110 judges the kind of the combined optional apparatus 200 through data communication with the optional apparatus control unit 210. However, it is also possible that the main body control unit 110 judges the kind of combined optional apparatus 200 by directly reading the 'optional apparatus kind information' stored in the optional apparatus memory 220. Additionally, it is possible that the main body control unit 110 reads address information from the optional apparatus memory 220, and judges the kind of combined optional apparatus 200 using the read address information and an address information/kind information table stored in the main body memory 120.

Then, the main body control unit 110 reads 'main body driving characteristic information' from the main body memory 120 as the 'main body specification information', and transmits the 'main body driving characteristic information' to the optional apparatus control unit 210 (operation S420). The optional apparatus control unit 210, if the 'main body driving characteristic information' is received (operation S425), sets the 'driving condition' of the optional apparatus driving unit 230 based on the received 'main body driving characteristic information' (operation S430).

Thereafter, if driving the optional apparatus 200 is required (for example, if the main body 100 performs a printing operation or a scanning operation), the main body control unit 110 transmits the 'optional apparatus driving command' to the optional apparatus control unit 210 (operation S435). If the 'optional apparatus driving command' is received (operation S440), the optional apparatus control unit 210 controls the optional apparatus driving unit 230 to operate according to the 'driving condition' set at the operation S430 (operation S445).

Then, if an abnormal operation of the optional apparatus driving unit 230 occurs (operation S450), the optional apparatus control unit 210 transmits the 'abnormal operation reporting message' for reporting the occurrence of the abnormal operation of the optional apparatus 200 to the main body control unit 110 (operation S455).

If the 'abnormal operation reporting message' is received (operation S460), the main body control unit 110 judges whether the abnormal operation state can be restored (operation S465). If the abnormal operation state can be restored, the main body control unit 110 restores the abnormal state (operation S470), and then retransmits the 'optional apparatus driving command' to the optional apparatus control unit 210 (operation S435). If the abnormal state cannot be restored, the main body control unit 110 displays the message for reporting the occurrence of the abnormal operation of the optional apparatus 200 on a display unit (not illustrated) provided in the main body 100 (operation S475).

Hereinafter, the operation of the optional apparatus according to the present invention will be explained in more detail on the assumption that the optional feeding apparatus is a kind of the optional apparatus 200 that is combined into the main body 100. In the present invention, because no feeding means is provided in the main body 100 of the image forming device, the optional feeding apparatus serves as a basic feeding apparatus of the image forming device.

Figure 6:
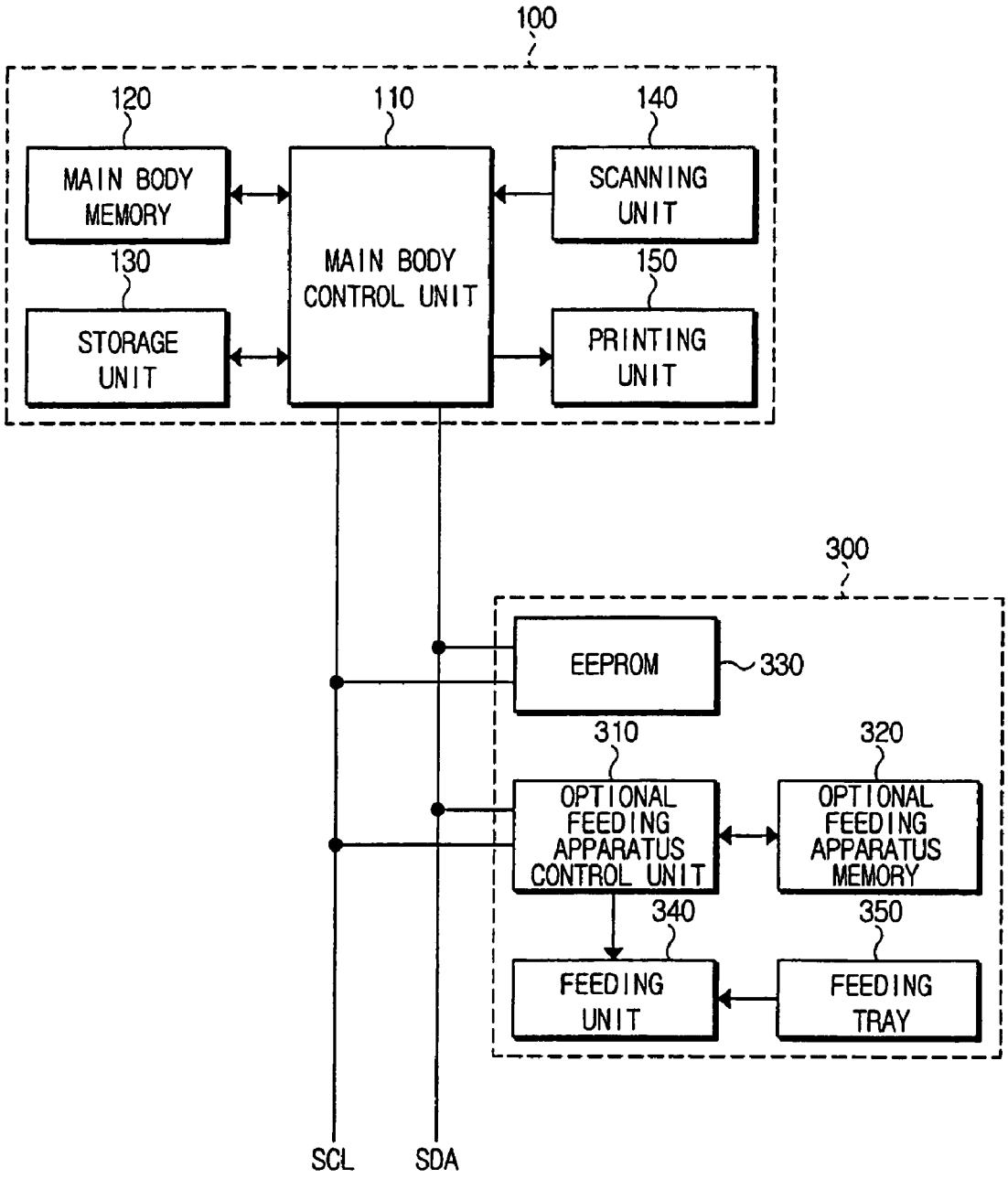
FIG. 6 is a block diagram illustrating a feeding apparatus communicably connected to the main body as an optional apparatus according to an embodiment of the present invention.

FIG. 6 is a block diagram illustrating an optional feeding apparatus combined into the main body as the optional apparatus according to an embodiment of the present invention. Referring to FIG. 6, the main body 100 includes a main body control unit 110, a main body memory 120, a storage unit 130, a scanning unit 140 and a printing unit 150. The optional feeding apparatus 300 includes an optional feeding apparatus control unit 310, an optional feeding apparatus memory 320, an EEPROM (Electrically Erasable Programmable Read Only Memory) 330, a feeding unit 340 and a feeding tray 350.

The main body control unit 110, optional feeding apparatus control unit 310 and EEPROM 330 are communicably connected with one another through an $I^2C$ (Inter-Integrated Circuit) bus. The $I^2C$ bus is a bus for the control and communications among ICs, and is composed of a serial clock line SCL and a serial data line SDA.

The main body control unit 110 controls the whole operation of the main body 100, and performs data communications with the optional feeding apparatus control unit 310 and the EEPROM 330 through the $I^2C$ bus. Specifically, the main body control unit 110 reads the 'kind information' stored in the EEPROM 330, and transmits 'main body printing speed information' and 'feeding command' to the optional feeding apparatus control unit 310.

The main body memory 120 is a recording medium in which the 'main body printing speed information' and 'kind information' read from EEPROM 330 are stored.

The scanning unit 140 produces image data by scanning the manuscript papers. The storage unit 130 is a recording medium in which the image data produced from the scanning unit 140 and print data transmitted from a PC (not illustrated) are stored. The printing unit 150 prints the image data and the print data stored in the storage unit 130 on the printing papers fed by the optional feeding apparatus 300.

The optional feeding apparatus control unit 310 controls the whole operation of the optional feeding apparatus 300, and performs data communications with the main body control unit 110 through the $I^2C$ bus. Specifically, the optional feeding apparatus control unit 310 receives 'main body printing speed information' from the main body control unit 110, and sets the 'feeding condition' of the feeding unit 340 based on the 'main body printing speed information'. The set 'feeding condition' includes a 'feeding speed' and a 'feeding interval'. If the 'feeding command' is received from the main body control unit 110, the feeding apparatus control unit 310 controls the feeding unit 340 according to the set 'feeding condition' to feed the printing papers.

The optional feeding apparatus memory 320 is a recording medium in which the 'main body printing speed information' received from the main body control unit 110 and the set 'feeding condition' is stored.

The feeding unit 340 feeds the printing papers loaded in the feeding tray 350 to the printing unit 150 of the main body 100. The feeding unit 340 is driven under the control of the optional feeding apparatus control unit 310.

Figure 7:
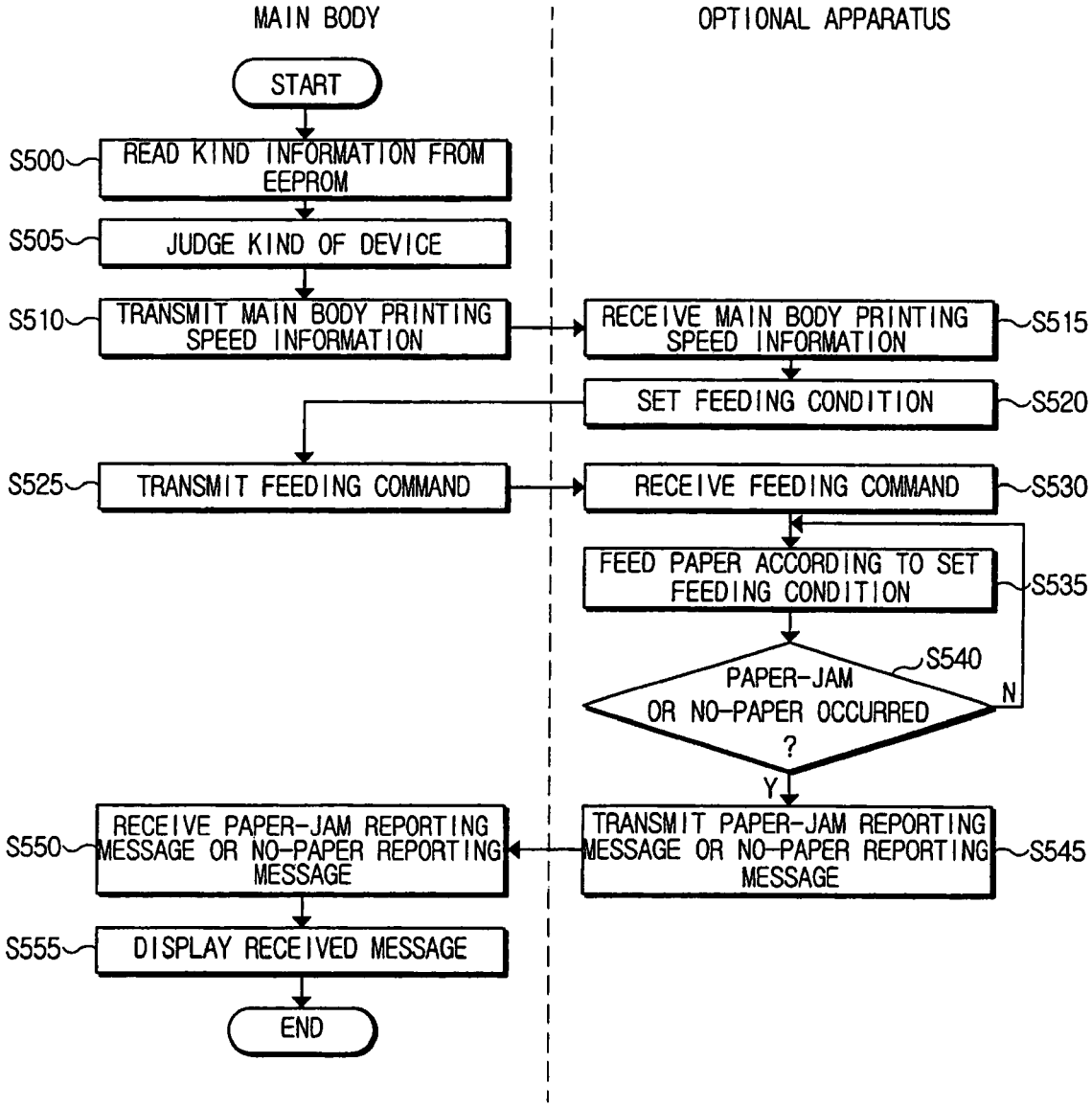
FIG. 7 is a flowchart illustrating a method for setting a driving condition of an optional feeding apparatus using the transmitted specification information of the main body according to an embodiment of the present invention.

Hereinafter, the process of setting the 'feeding condition' of the optional feeding apparatus 300 itself through mutual communication if the main body 100 and the optional feeding apparatus 300 are combined together, and driving the optional feeding apparatus 300 according to the set feeding condition will be explained in detail with reference to FIG. 7. FIG. 7 is a flowchart illustrating a method for setting the feeding condition of the optional feeding apparatus using the transmitted printing speed information of the main body according to an embodiment of the present invention. For the purpose of convenience, operations performed by the main body 100 are illustrated on the left side of FIG. 7, and operations performed by the optional feeding apparatus 300 are illustrated on the right side of FIG. 7.

The main body control unit 110 reads the 'kind information' stored in the EEPROM 330 of the optional feeding apparatus 300 through the $I^2C$ bus (operation S500). In this case, the read 'kind information' refers to the 'optional feeding apparatus'. Accordingly, the main body control unit 110 judges that the optional feeding apparatus 300 is combined into the main body 100 (operation S505).

Additionally, it is also possible that the main body control unit 110 reads the address information from the EEPROM 330, and judges the kind of the device using the read address information and the address information/kind information table stored in the main body memory 120.

Then, the main body control unit 110 reads the 'main body printing speed information' from the main body memory 320 and transmits the read 'main body printing speed information' to the optional feeding apparatus control unit 310 (operation S510). If the 'main body printing speed information' is received (operation S515), the optional feeding apparatus control unit 310 sets the feeding condition of the feeding unit 340 based on the received 'main body printing speed information' (operation S520).

For example, if the received 'main body printing speed information' is 60 PPM (Pages Per Minute), the optional feeding apparatus control unit 310 sets the 'feeding condition' (i.e., feeding speed and feeding interval) of the feeding unit 340 so that the feeding is performed at a speed of 60 PPM.

Then, if feeding is required (for example, if the printing unit 150 of the main body 100 performs the printing operation), the main body control unit 110 transmits a 'feeding command' to the optional feeding apparatus control unit 310 (operation S525). If the 'feeding command' is received (operation S530), the optional feeding apparatus control unit 310 controls the feeding unit 340 to operate according to the 'feeding condition' set at operation S520 (operation S535).

Thereafter, if a paper-jam or no-paper state occurs (operation S540), the optional feeding apparatus control unit 310 transmits a 'paper-jam reporting message' or 'no-paper reporting message' to the main body control unit 110 (operation S545).

If the 'paper-jam reporting message' or 'no-paper reporting message' is received (operation S550), the main body control unit 110 displays the received 'paper-jam reporting message' or 'no-paper reporting message' on a display unit (not illustrated) provided in the main body 100.

As described above, it is shown that the optional apparatus of the image forming device received the specification information of the main body and sets its own driving condition using the received specification information. Additionally, it is shown that the optional feeding apparatus that is a kind of optional apparatus receives the printing speed information of the main body and sets its own feeding condition using the received printing speed information of the main body.

In addition, it will be apparent to those skilled in the art that the present invention can be applied to any optional apparatus that is additionally combined into an image forming device and expands the function of the image forming device such as an automatic manuscript paper feeding apparatus, finisher, etc. The present invention can also be applied to various kinds of optional apparatuses combined into the main body.

As described above, according to the present invention, the optional apparatus combined into the main body of the image forming device receives specification information of the main body and sets its own driving condition using the received specification information so as to be driven according to the set driving condition. Accordingly, the optional apparatus can be implemented as a general optional apparatus that can be combined into any kind of image forming device, and thus it is not required to develop a separate optional apparatus for each kind of image forming device.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A general optional apparatus of an image forming device that is additionally combined into a main body of the image forming device to expand functions of the image forming device, the optional apparatus comprising:

a driving unit driven to perform an addition function required to expand the functions of the image forming device;

a control unit for directly receiving specification information of the main body from the main body, setting a driving condition of the driving unit based on the received specification information, and then controlling the driving unit according to the set driving condition; and a memory for storing the driving condition set by the control unit, wherein the specification information is driving characteristic information of the main body.

2. The general optional apparatus as claimed in claim 1, wherein the control unit, if a driving command is received from the main body, controls the driving unit according to the driving condition stored in the memory.

3. The general optional apparatus as claimed in claim 2, wherein the control unit transmits an abnormal operation reporting message to the main body if the driving unit operates abnormally.

4. The general optional apparatus as claimed in claim 1, wherein the control unit receives the specification information from the main body through an $I^2C$ (Inter-Integrated Circuit) bus.

5. The general optional apparatus as claimed in claim 1, wherein the additional function performed by the driving unit is any one of a printing paper feeding function, an automatic manuscript paper feeding function, and a printed paper classifying/sorting function.

6. A method for controlling a general optional apparatus of an image forming device that is additionally combined into a main body of the image forming device to expand functions of the image forming device, the method comprising:

directly receiving specification information of the main body from the main body;

setting a driving condition of a driving unit driven to perform an addition function required to expand the functions of the image forming device based on the received specification information;

controlling the driving unit according to the set driving condition;

storing the set driving condition in a memory; and transmitting an abnormal operation reporting message to the main body if the driving unit operates abnormally, wherein the specification information is driving characteristic information of the main body.

7. The method as claimed in claim 6, wherein controlling the driving unit according to the stored driving condition occurs if a driving command is received from the main body.

8. The method as claimed in claim 6, wherein receiving the specification information from the main body occurs through an $I^2C$ (Inter-Integrated Circuit) bus.

9. The method as claimed in claim 6, wherein the additional function performed by the driving unit is any one of a printing paper feeding function, an automatic manuscript paper feeding function, and a printed paper classifying/sorting function.

10. A method for controlling a general optional apparatus connected to an image forming apparatus having a main body, the method comprising:

judging the kind of optional apparatus that is connected to the image forming apparatus;

directly transmitting main body driving characteristic information from the main body to the optional apparatus;

setting driving conditions of the optional apparatus;

transmitting optional apparatus driving commands from the main body to the optional apparatus; and driving the optional apparatus according to the set driving conditions, wherein judging the kind of optional apparatus that is connected to the image forming apparatus includes searching the optional apparatus and requesting specification information and directly transmitting optional apparatus kind information from the optional apparatus to a control unit of the main body.

11. The method according to claim 10, further comprising:

determining if an abnormal operation has occurred in the optional apparatus; and transmitting an abnormal operation reporting message from the optional apparatus to the main body.

12. The method according to claim 11, further comprising:

determining if the abnormal operation may be restored;

determining if the abnormal operation may be restored to a normal operation; and displaying an abnormal operation reporting message in the main body.

13. The method according to claim 10, wherein the general optional apparatus is a paper feeding apparatus.

14. The method according to claim 10, wherein the general optional apparatus is an automatic manuscript paper feeding apparatus.

15. The method according to claim 10, wherein the general optional apparatus is a paper classifying/sorting apparatus.

16. The method according to claim 10, wherein the main body driving characteristic information is transmitted to the optional apparatus through an Inter-Integrated Circuit bus.

17. The method according to claim 10, wherein the general optional apparatus is connected structurally and electrically to the main body.

* * * * *